US011369825B2

(12) United States Patent
Holton

(10) Patent No.: US 11,369,825 B2
(45) Date of Patent: Jun. 28, 2022

(54) BALANCING EXERCISE ROD APPARATUS

(71) Applicant: Mary Holton, Seagoville, TX (US)

(72) Inventor: Mary Holton, Seagoville, TX (US)

( * ) Notice: Subject to any disclaimer, the term of this patent is extended or adjusted under 35 U.S.C. 154(b) by 79 days.

(21) Appl. No.: 17/011,044

(22) Filed: Sep. 3, 2020

(65) Prior Publication Data

US 2022/0062684 A1 Mar. 3, 2022

(51) Int. Cl.

*A63B 21/072* (2006.01)
*A63B 26/00* (2006.01)
*A63B 21/075* (2006.01)

(52) U.S. Cl.

CPC ..... *A63B 21/0724* (2013.01); *A63B 21/075* (2013.01); *A63B 21/0728* (2013.01); *A63B 26/003* (2013.01)

(58) Field of Classification Search

CPC ..... A63B 21/00058; A63B 21/00061; A63B 21/00065; A63B 19/02; A63B 21/0004; A63B 21/045; A63B 21/0455; A63B 21/0608; A63B 21/0615; A63B 21/072; A63B 21/0722; A63B 21/0724; A63B 21/0726; A63B 21/0728; A63B 21/075; A63B 21/22; A63B 21/222; A63B 21/4049; A63B 22/20; A63B 21/06–0605; A63B 26/003

See application file for complete search history.

(56) References Cited

U.S. PATENT DOCUMENTS 1,552,073 A 9/1925 Mansfeldt
3,758,109 A * 9/1973 Bender ..... A63B 21/0605 482/93
4,029,312 A 6/1977 Wright
4,225,132 A * 9/1980 Archambault ..... A63B 21/0004 482/125
4,775,147 A * 10/1988 Bold, Jr. ..... A63B 21/227 482/108
5,239,396 A * 8/1993 Thompson ..... G02B 5/32 359/1
6,379,286 B1 * 4/2002 Scopino ..... A63B 15/00 482/93
7,011,610 B2 * 3/2006 Wawrzyniak ..... A63B 21/0726 482/104
7,389,599 B2 6/2008 Hishinuma
8,900,104 B2 * 12/2014 Shozda ..... A63B 21/0724 482/108
9,005,088 B2 4/2015 Sides, Jr.
9,050,495 B2 6/2015 Sieben
9,180,335 B1 * 11/2015 Wu ..... A63B 23/0205

(Continued)

*Primary Examiner* — Garrett K Atkinson
*Assistant Examiner* — Kathleen M Fisk

(57) ABSTRACT

A balancing exercise rod apparatus for working out while walking or jogging includes a grip bar having a left end and a right end. A pair of wheels is coupled to the grip bar. The pair of wheels includes a left wheel and a right wheel rotatably coupled to the left end and the right end of the grip bar, respectively. Each of the wheels has a hub rotatably coupled to the grip bar, a plurality of spokes extending from the hub, and a rim portion. The rim portion has an inner side, an outer side, an interior face, and an exterior face. The plurality of spokes extends from the hub to the interior face. A plurality of wheel weights is coupled to the pair of wheels. The plurality of wheel weights is coupled within the rim portion.

8 Claims, 5 Drawing Sheets

(56) References Cited

U.S. PATENT DOCUMENTS

| | | | | |
|---|---|---|---|---|
| 9,844,696 | B2 | 12/2017 | Anderson | |
| 10,046,198 | B1 * | 8/2018 | Huang | A63B 21/4045 |
| 2012/0295775 | A1 * | 11/2012 | Reid | A63B 22/20 482/108 |
| 2013/0012369 | A1 * | 1/2013 | Prest | A63B 21/0726 482/132 |
| 2014/0221174 | A1 | 8/2014 | Lin | |
| 2017/0274240 | A1 * | 9/2017 | Pong | A63B 21/00065 |
| 2018/0056120 | A1 * | 3/2018 | Brown | A63B 21/4035 |

* cited by examiner

BALANCING EXERCISE ROD APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercise devices and more particularly pertains to a new exercise device for working out while walking or jogging.

(2) Description of Related Art Including Information Disclosed Under 37 CFR 1.97 and 1.98

The prior art relates to exercise devices. Known barbells have various forms of adjusting their weight, typically by adding and removing weight plates. These devices do not have weight compartments within the bar itself to adjust weight. They also lack permanently affixed rotating wheels with weight compartments within the wheel.

BRIEF SUMMARY OF THE INVENTION

An embodiment of the disclosure meets the needs presented above by generally comprising a grip bar having a left end and a right end. A pair of wheels is coupled to the grip bar. The pair of wheels includes a left wheel and a right wheel rotatably coupled to the left end and the right end of the grip bar, respectively. Each of the wheels has a hub rotatably coupled to the grip bar, a plurality of spokes extending from the hub, and a rim portion. The rim portion has an inner side, an outer side, an interior face, and an exterior face. The plurality of spokes extends from the hub to the interior face. A plurality of wheel weights is coupled to the pair of wheels. The plurality of wheel weights is coupled within the rim portion.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
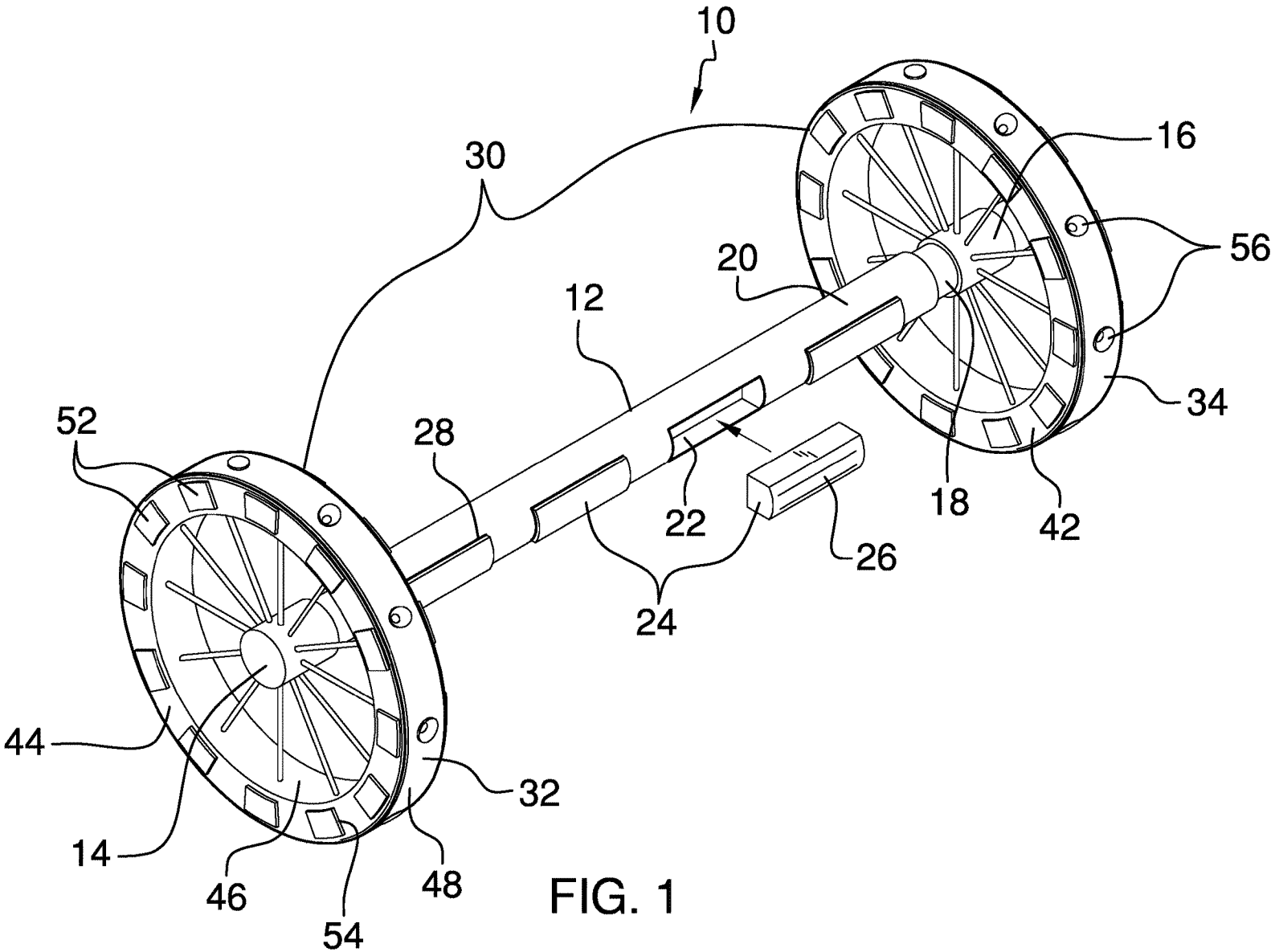
FIG. 1 is an isometric view of a balancing exercise rod apparatus according to an embodiment of the disclosure.
Figure 2:
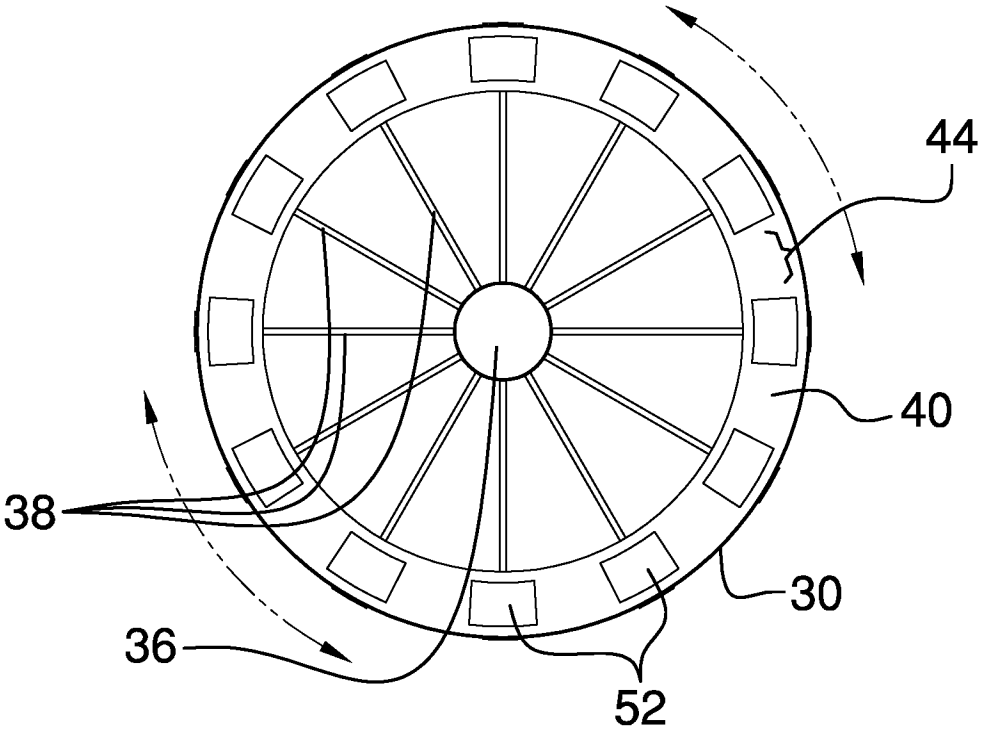
FIG. 2 is a side elevation view of an embodiment of the disclosure.
Figure 3:
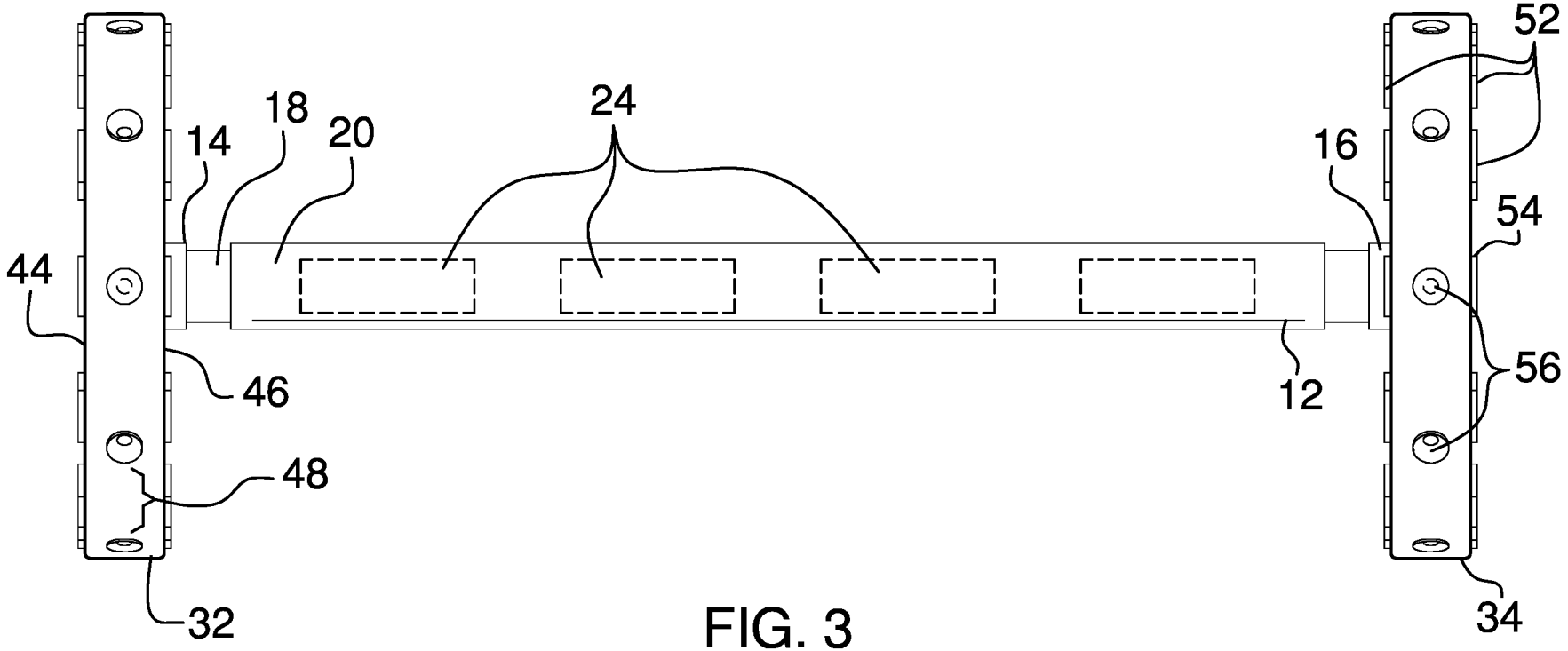
FIG. 3 is a rear elevation view of an embodiment of the disclosure.
Figure 4:
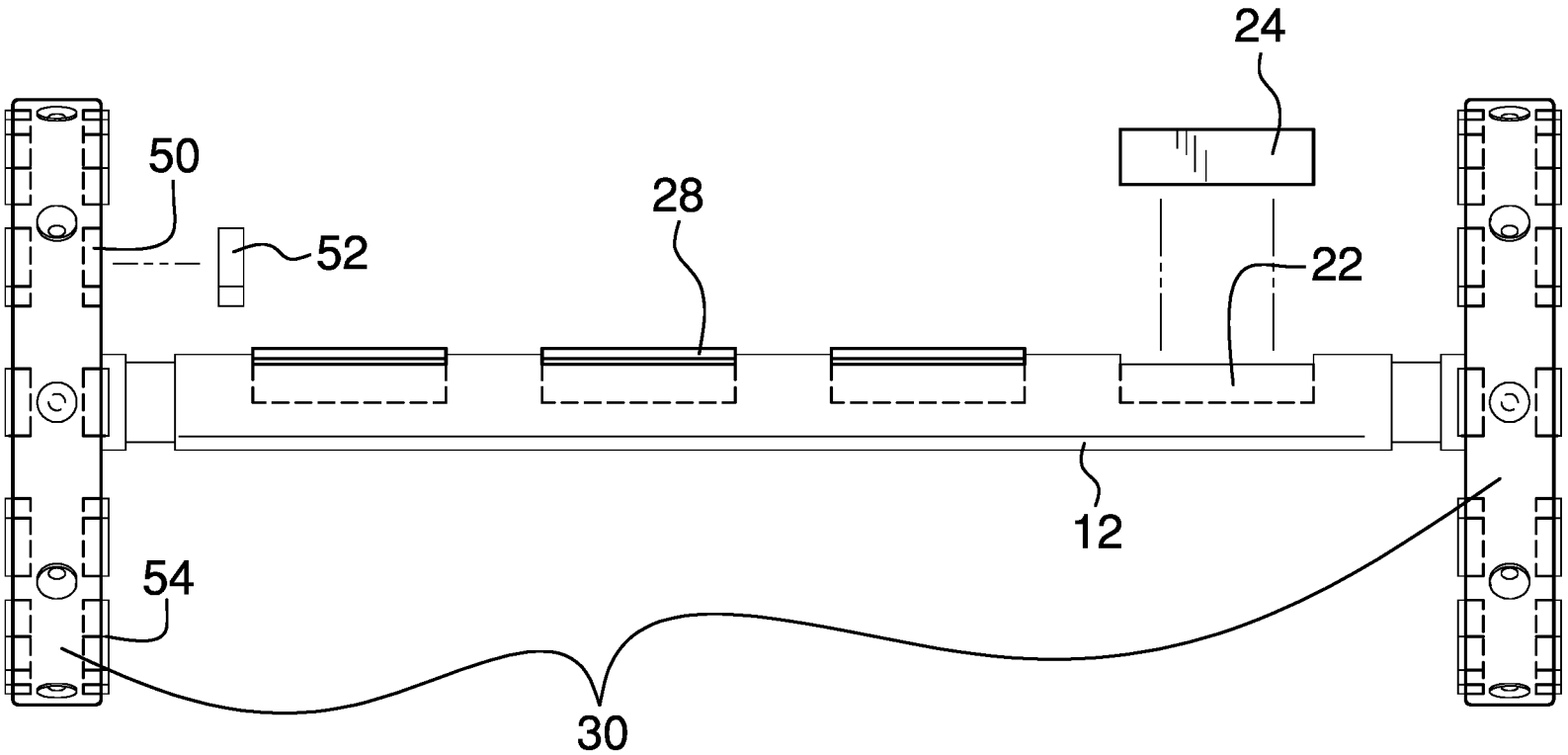
FIG. 4 is a bottom plan view of an embodiment of the disclosure.
Figure 5:
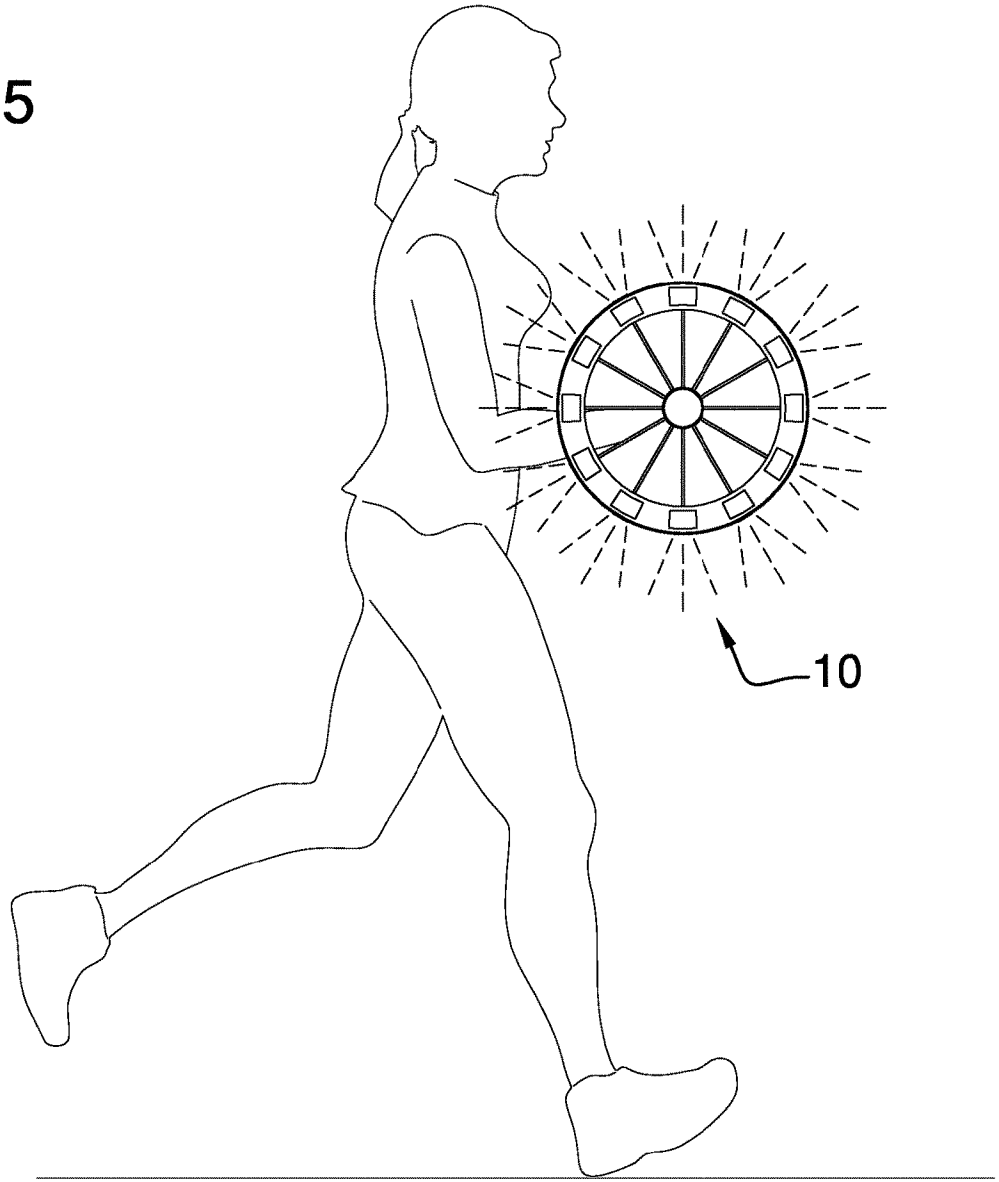
FIG. 5 is an in-use view of an embodiment of the disclosure.

With reference now to the drawings, and in particular to FIGS. 1 through 5 thereof, a new exercise device embodying the principles and concepts of an embodiment of the disclosure and generally designated by the reference numeral 10 will be described.

As best illustrated in FIGS. 1 through 5, the balancing exercise rod apparatus 10 generally comprises a grip bar 12 having a left end 14 and a right end 16. The grip bar 12 has an inner bar portion 18 and an outer pad portion 20. The grip bar 12 may have a plurality of bar cavities 22 extending through the outer pad portion 20 and into the inner bar portion 18.

A plurality of bar weights 24 is coupled to the grip bar 12. The plurality of bar weights 24 is selectively engageable within the plurality of bar cavities 22. Each bar weight 24 has a curved outer face 26 conforming to the curvature of the grip bar 12. The thickness of each bar weight 24 is greater than the depth of each bar cavity 22 to allow for an exposed bar weight portion 28 of the bar weight while engaged within the bar cavity 22.

A pair of wheels 30 is coupled to the grip bar 12. The pair of wheels 30 includes a left wheel 32 and a right wheel 34 rotatably coupled to the left end 14 and the right end 16 of the grip bar, respectively. Each of the wheels 30 has a hub 36 rotatably coupled to the grip bar 12. A plurality of spokes 38 extends from the hub 36. A rim portion 40 has an inner side 42, an outer side 44, an interior face 46, and an exterior face 48. The plurality of spokes 38 extends from the hub 36 to the interior face 46. The inner side 42 and the outer side 44 may each have a plurality of wheel cavities 50 with each of the wheel cavities 50 being evenly radially spaced around the hub 36.

A plurality of wheel weights 52 is coupled to the pair of wheels 30. The plurality of wheel weights 52 is selectively engageable within the plurality of wheel cavities 50. Each wheel weight 52 conforms to the profile of each wheel cavity 50. The thickness of each wheel weight 52 is greater than the depth of each wheel cavity 50 to allow for an exposed wheel weight portion 54 of the wheel weight while engaged within the wheel cavity 50.

A plurality of reflectors 56 may be coupled to the pair of wheels 30. The plurality of reflectors 56 may be coupled to the exterior face 48 of each rim portion 40. Each reflector 56 may be circular and may include an integrated LED light in operational communication with a power source.

In use, the plurality of bar weights 24 and the plurality of wheel weights 52 are engaged within the plurality of bar cavities 22 and the plurality of wheel cavities 50, respectively. The user then secures the grip bar 12 while walking or running to exercise his or her upper body and abdominal stability.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A balancing exercise rod apparatus comprising:

a grip bar, the grip bar having a left end and a right end;

a pair of wheels coupled to the grip bar, the pair of wheels including a left wheel and a right wheel rotatably coupled to the left end and the right end of the grip bar, respectively, each wheel of the pair of wheels having a hub rotatably coupled to the grip bar, a plurality of spokes extending from the hub, and a rim portion, the rim portion having an inner side, an outer side, an interior face, and an exterior face, the plurality of spokes extending from the hub to the interior face;

a plurality of wheel weights coupled to the pair of wheels, the plurality of wheel weights being coupled within the rim portion of each wheel of the pair of wheels;

the grip bar having a plurality of bar cavities; a plurality of bar weights being coupled to the grip bar, the plurality of bar weights being selectively engageable within the plurality of bar cavities; and each bar weight of the plurality of bar weights having a curved outer face conforming to a curvature of the grip bar, a thickness of each bar weight of the plurality of bar weights being greater than a depth of each bar cavity of the plurality of bar cavities to allow for an exposed bar weight portion of each bar weight of the plurality of bar weights while engaged within an associated one of the bar cavities of the plurality of bar cavities.

2. The balancing exercise rod apparatus of claim 1 further comprising the inner side and the outer side of the rim portion of each wheel of the pair of wheels having a plurality of wheel cavities; the plurality of wheel weights being selectively engageable within the plurality of wheel cavities.

3. The balancing exercise rod apparatus of claim 2 further comprising each wheel cavity of the plurality of wheel cavities being evenly radially spaced around the hub of each wheel of the pair of wheels.

4. The balancing exercise rod apparatus of claim 2 further comprising each wheel weight of the plurality of wheel weights conforming to the profile of each wheel cavity of the plurality of wheel cavities, a thickness of each wheel weight of the plurality of wheel weights being greater than a depth of each wheel cavity of the plurality of wheel cavities to allow for an exposed wheel weight portion of each wheel weight of the plurality of wheel weights while engaged within an associated one of the wheel cavities of the plurality of wheel cavities.

5. The balancing exercise rod apparatus of claim 1 further comprising a plurality of reflectors coupled to the pair of wheels.

6. The balancing exercise rod apparatus of claim 5 further comprising the plurality of reflectors being coupled to the exterior face of each rim portion.

7. The balancing exercise rod apparatus of claim 1 further comprising the grip bar having an inner bar portion and an outer pad portion.

8. A balancing exercise rod apparatus comprising:

a grip bar, the grip bar having a left end and a right end, the grip bar having an inner bar portion and an outer pad portion, the grip bar having a plurality of bar cavities extending through the outer pad portion and into the inner bar portion;

a plurality of bar weights being coupled to the grip bar, the plurality of bar weights being selectively engageable within the plurality of bar cavities, each bar weight of the plurality of bar weights having a curved outer face conforming to a curvature of the grip bar, a thickness of each bar weight of the plurality of bar weights being greater than a depth of each bar cavity of the plurality of bar cavities to allow for an exposed bar weight portion of each bar weight of the plurality of bar weights while engaged within an associated bar cavity of the plurality of bar cavities;

a pair of wheels coupled to the grip bar, the pair of wheels including a left wheel and a right wheel rotatably coupled to the left end and the right end of the grip bar, respectively, each wheel of the pair of wheels having a hub rotatably coupled to the grip bar, a plurality of spokes extending from the hub, and a rim portion, the rim portion having an inner side, an outer side, an interior face, and an exterior face, the plurality of spokes extending from the hub to the interior face, the inner side and the outer side having a plurality of wheel cavities, each wheel cavity of the plurality of wheel cavities being evenly radially spaced around the hub;

a plurality of wheel weights coupled to the pair of wheels, the plurality of wheel weights being selectively engageable within the plurality of wheel cavities, each wheel weight of the plurality of wheel weights conforming to the profile of each wheel cavity of the plurality of wheel cavities, a thickness of each wheel weight of the plurality of wheel weights being greater than a depth of each wheel cavity of the plurality of wheel cavities to allow for an exposed wheel weight portion of each wheel weight of the plurality of wheel weights while engaged within an associated wheel cavity of the plurality of wheel cavities; and a plurality of reflectors coupled to the pair of wheels, the plurality of reflectors being coupled to the exterior face of the rim portion of each wheel of the pair of wheels.

* * * * *